United States Patent [19]

Wada et al.

[11] 4,330,963

[45] May 25, 1982

[54] APPARATUS FOR GRINDING FINISH OF PISTON RINGS

[75] Inventors: Masahiko Wada; Junji Shirogane, both of Kashiwazaki, Japan

[73] Assignee: Kabushiki Kaisha Riken, Tokyo, Japan

[21] Appl. No.: 131,424

[22] Filed: Mar. 18, 1980

[51] Int. Cl.[3] ..... B24B 25/00

[52] U.S. Cl. ..... 51/157; 51/161; 51/211 R; 51/347

[58] Field of Search ..... 51/157, 161, 325, 354, 51/352, 353, 290, 347, 211 R

[56] References Cited

U.S. PATENT DOCUMENTS

| | | | |
|---|---|---|---|
| 1,511,165 | 10/1924 | Jaeger | 51/347 |
| 2,195,056 | 3/1940 | Wallace | 51/217 R |
| 2,318,837 | 5/1943 | Connor | 51/290 |
| 3,296,747 | 1/1967 | Philippsen | 51/157 |

FOREIGN PATENT DOCUMENTS

| | | | |
|---|---|---|---|
| 1216730 | 5/1966 | Fed. Rep. of Germany . | |
| 322950 | 12/1929 | United Kingdom | 51/157 |

*Primary Examiner*—Harold D. Whitehead
*Attorney, Agent, or Firm*—Arthur S. Garrett

[57] ABSTRACT

An apparatus for grinding the finish of piston rings comprises a grinding sleeve having a plurality of sleeve elements forming a cylindrical hollow member, and an adjuster to move the sleeve elements in unison in the radial direction thereof to maintain for the internal diameter of the cylindrical member substantially equal to the nominal dimension of the piston ring as the grindstones on the sleeve elements are worn down.

1 Claim, 8 Drawing Figures

APPARATUS FOR GRINDING FINISH OF PISTON RINGS

BACKGROUND OF THE INVENTION

This invention relates to an apparatus for grinding the finish of piston rings, and more particularly to improvements in an apparatus provided with sleeve means which are subject to wear after grinding the finish of an outer peripheral surface of numerous piston rings.

The accuracy in grinding the finish on the outer peripheral surface of piston rings will have a significant effect on the performance of the piston rings, particularly on sealing requirements thereof. Therefore, it has been necessary, during production of the piston rings, to give special attention to the grinding finish step in order to achieve the finest quality of finish on the workpiece.

It is a conventional and effective practice to apply the finish by holding the piston ring within a sleeve and vertically moving the ring in frictional engagement with the grindstones or diamond lapped tools in the sleeve. More specifically, the self-exerted outward expansion of the piston ring to the ground presses the outer surface of the piston ring onto the inner surface of the sleeve with the nominal dimension of the piston ring being substantially equal to the internal diameter of the sleeve.

A serious problem results in that numerous piston rings have to be finished and rapid wearing down the grindstones fixed to the internal surface of the sleeve results in enlarging the internal diameter thereof.

When the grindstones are worn down to the point that grinding effeciency suffers, no sleeve can provide uniform tolerances of finished piston rings. As a result, the conventional sleeve has to be replaced with to a new sleeve which is of the internal diameter equal to the nominal dimension of the piston ring. Such an exchange of the sleeves may considerably decrease the working efficiency due to interruption of the finishing step operation and substantially increases manufacturing cost.

SUMMARY OF THE INVENTION

Accordingly, it is one of the objects of the present invention to provide an apparatus for grinding the finish of an outer peripheral surface of piston rings which obviates the conventional defects as mentioned above.

It is another object of the present invention to provide an apparatus for grinding the finish of an outer peripheral surface of piston rings including sleeve means which does not require replacement of the sleeve even after the internal surface of sleeve means has worn beyond a predetermined extent.

It is a further object of the present invention to provide an apparatus for grinding the finish of an outer peripheral surface of piston rings including sleeve means which has a plurality of sleeve elements movable in a radial direction so as to adjust the internal diameter thereof.

The above and other objects, features and advantages of the present invention, will be apparent in the following detailed descriptions of illustrative embodiments thereof which are to be read in connection with the accompanying drawings.

DETAILED DESCRIPTION OF THE PREFERRED EMBODIMENTS

Figure 1:
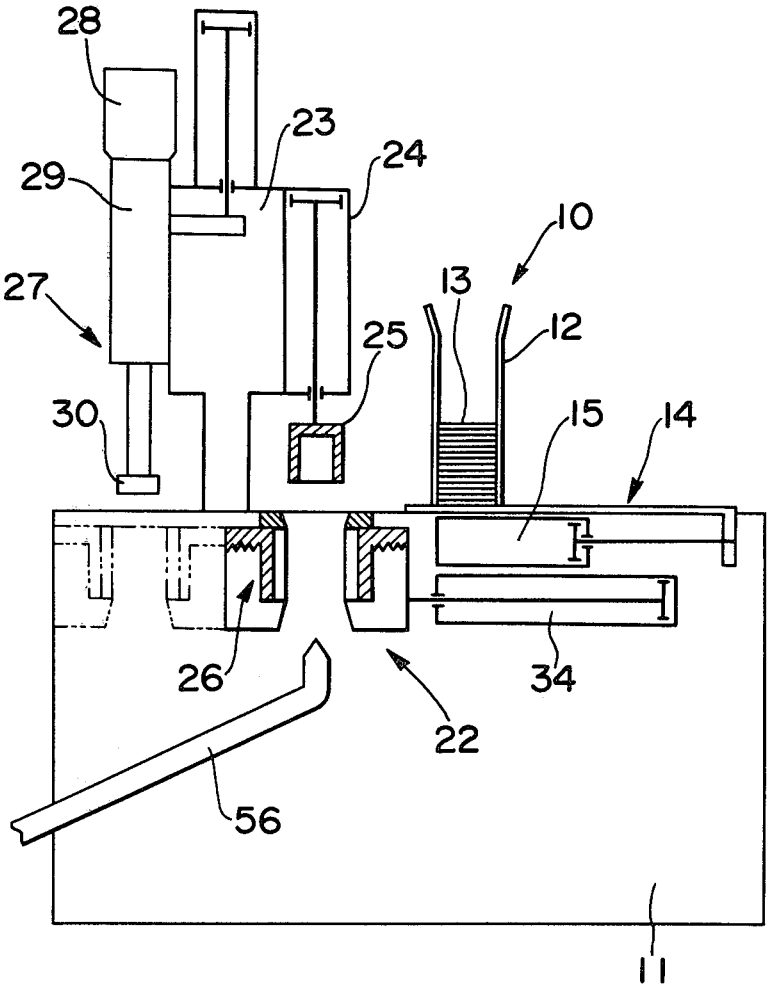
FIG. 1 is a schematic illustration of an apparatus for performing finishing of an outer peripheral surface of piston rings.
Figure 2:
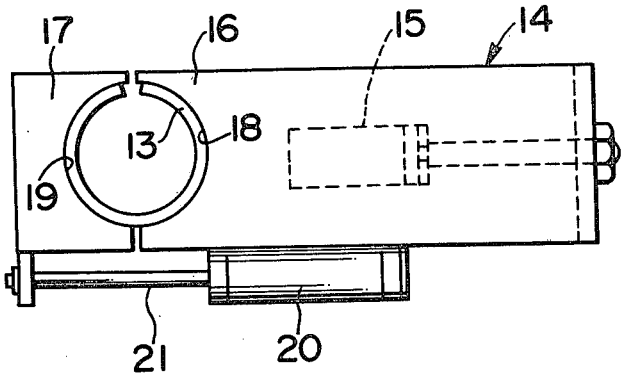
FIG. 2 is a partial plan view of the apparatus of FIG. 1.

Referring now to the drawings, especially FIG. 1, there is schematically shown an apparatus for finishing an outer peripheral surface of piston rings generally indicated by the reference numeral 10 which includes a body frame 11, a magazine 12 fixed on the body frame 11 for holding therein piston rings 13 to be finished, and a slidable plate 14 actuated by a fluid motor 15 mounted on the body frame 11. The magazine 12 is opened at the upper end thereof and spaced from the body frame 11 at the lower end thereof with a clearance a little greater than the axial thickness of each piston ring 13. The slidable plate 14 comprises opposed plate elements 16, 17 provided with semicircular recesses 18, 19 to hold the piston ring 13 as illustrated in FIG. 2. More specifically, the plate element 16 is secured to a cylinder body 20 while the plate element 17 is secured to a plunger 21 movably mounted in the cylinder body 20 to thereby enable the plate elements 16, 17 to approach and be separated from each other. When the plate elements 16, 17 approach the maximum extent, the semicircular recesses 18, 19 constitute a circle of a diameter somewhat greater than the nominal dimension of the piston ring 13. The piston ring 13 to be finished may be placed between the body elements 16, 17 while the body elements 16, 17 are moved away from each other and then may be held therebetween when the body elements 16, 17 approach each other again.

The apparatus 10 further includes a grinding or lapping device 22 which comprises a column 23 fixed on the body frame 11, a fluid motor 24 provided on the column 23, a depressing member 25 rigidly connected to the fluid motor 24 to be actuated thereby, and grinding sleeve means 26 carried on the body frame 11 and located in coaxial relationship with the depressing member 25. The column 23 is also provided with a dressing device 27 which includes a motor 28 and a spindle 29 actuated thereby and secured with a diamond dresser 30 at the tip thereof.

Figure 3:
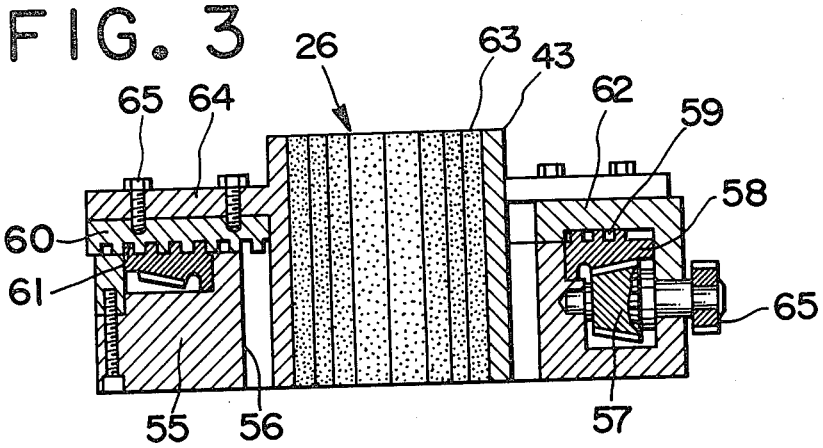
FIG. 3 is a longitudinal section of a grinding sleeve means according to the present invention used in the apparatus of FIG. 1.

In FIG. 3, the grinding sleeve means 26 comprises a body (55) carried on the body frame 11 and having a center hole (56), a plurality of inner sleeve elements 43 vertically extending through the center hole (56) of the body (55) and arranged to form a circle of the predetermined inner diameter and a cylindrical hollow member, pinion means (57) rotatably carried on the body (55), a scroll (58) mounted on the body (55) into engagement with the pinion means (57), and having a spiral groove (59), carriers (60) having rack means (61) which are meshed with the spiral groove (59) of the scroll (58), and guide means (62) for sliding the carrier (60) radially inwardly or outwardly when the scroll 58 is rotated by the pinion means (57). The inner sleeves (43) are provided at inner surface thereof with grindstones (63) and at outer surface with arms (64) extending radially outwardly, respectively. The arms (64) are secured to the carriers (60) by use of bolts (65).

When it is necessary to adjust the internal diameter of the grindstones (63) after the grinding finish of a lot of piston rings 13 and the wearing down of the grindstones beyond a predetermined level, a handle (65) is manipulated to rotate the pinion means (57) and the scroll (58) engaged therewith. The rotation of the scroll (58) causes the carrier (60) to be advanced radially inwardly, so that the internal diameter of the inner sleeve (43) is decreased. Then, the grinding sleeve means (26) is moved to the dressing station and the grindstones (63) are subjected to dressing operation to obtain the desired diameter thereof. After that, the grinding sleeve means (26) is returned to the original position, for example, by means of the fluid motor 34 to continue the finishing work of the piston rings 13.

Figure 4:
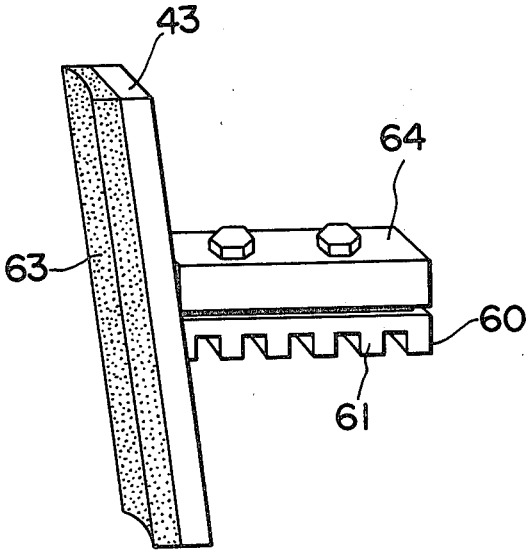
FIG. 4 is a perspective view of a modification of the inner sleeve element of FIG. 3.

As shown in FIG. 4, the grindstones (63) may be inclined with respect to the axis at the center hole (56) of the body to effectively finish the outer surface of the piston rings 13.

Figure 5:
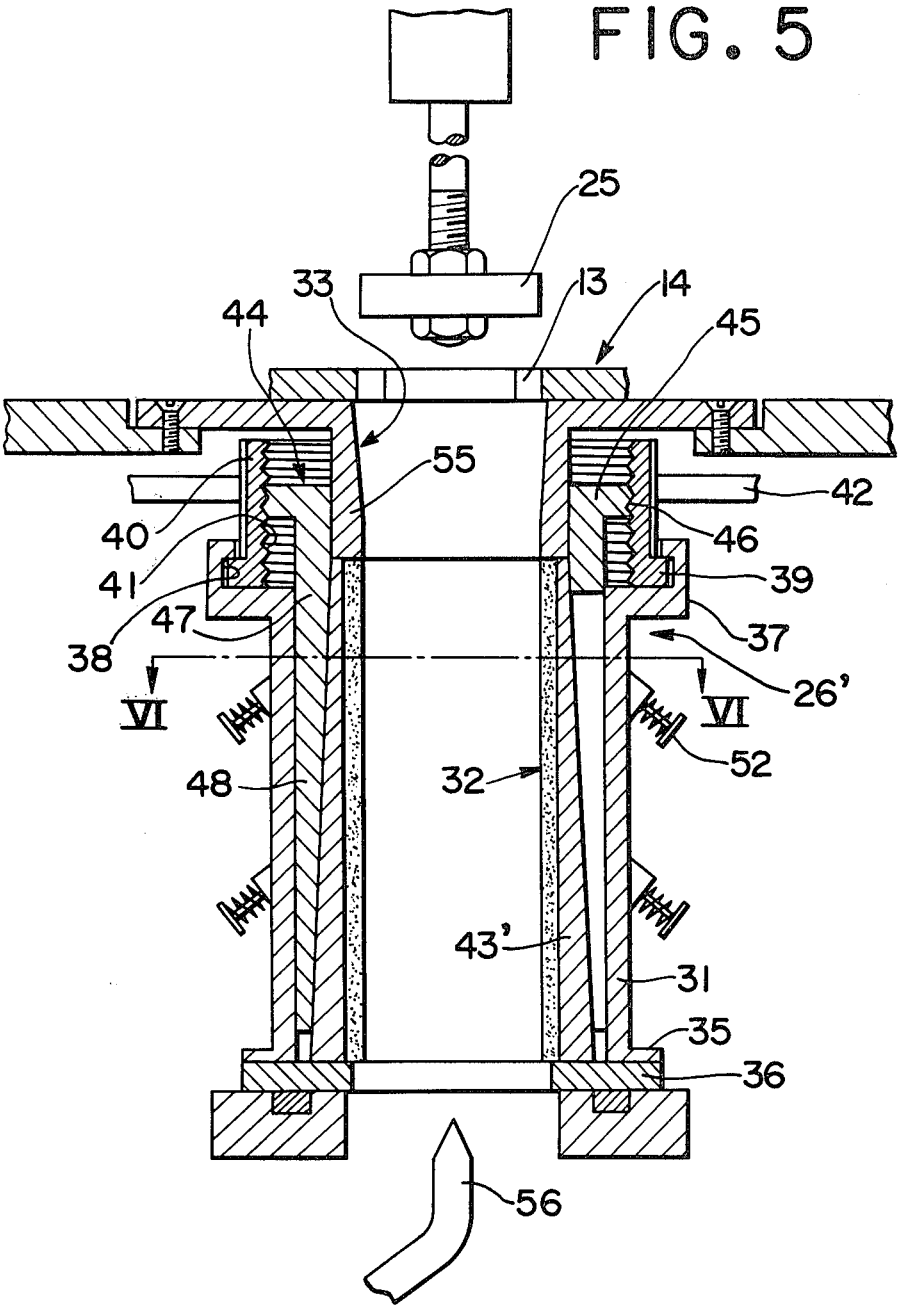
FIG. 5 is a longitudinal section of another embodiment of grinding sleeve means according to the present invention.

Another embodiment of grinding sleeve means 26′ as shown in FIG. 5 comprises an outer sleeve 31 carried on the body frame 11, a plurality of vertically standing inner sleeve elements 43′ slidably carried on the body frame 11 and fixedly adhered with a plurality of grindstones 32, and an upper sleeve 33 for guiding the piston ring 13 to be ground into contact with the grindstones 32. The grinding sleeve means 26′ is moved by a fluid motor 34 (FIG. 1) located in coaxial relationship with the diamond dresser 30 in the case that the grindstones 32 are to be applied with dressing.

In more detail, the outer sleeve 31 is provided at the lower end thereof with an annular flange 35 in slidable abutment on a base 36 fixedly mounted on the body frame 11 and at the upper end thereof with an annular flange 37 provided with a groove 38 in which a flange 39 of a cylindrical rotational member 40 is rotatably mounted. The rotational member 40 is provided on the internal surface thereof with screws 41 and connected to a handle 42 which extends in the radial direction of the grinding sleeve means 26′ to be manipulated. Thus, rotation of the handle 42 causes rotation of the rotational member 40 relative to the outer sleeve 31. Each of the inner sleeve elements 43′ has its outer wall surface inclined toward the upper direction at the outer surface thereof, thereby providing the wedge-shaped gap between the outer sleeve 31 and the inner sleeve element 43′.

Figure 6:
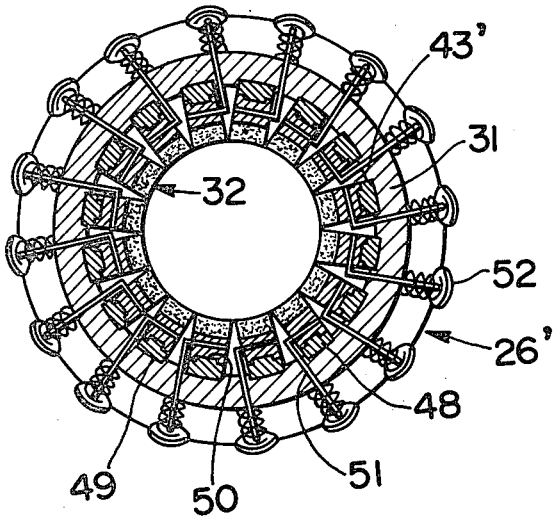
FIG. 6 is a cross-sectional view taken along the line VI—VI of FIG. 5.

An adjuster 44, interposed between the outer sleeve 31 and the inner sleeve element 43′, comprises an annular shoulder 45 provided with screws 46 in meshing engagement with the screws 41 of the rotational member 40, an annular body 47, and plurality of legs 48 tapered toward the downward direction at the inner surface thereof, each leg 48 being circumferentially spaced and interposed between the outer sleeve 31 and each of the inner sleeves element 43′ (FIG. 6). A radially outer face 49 of each leg 48 is slidably inserted in the longitudinal groove of the sleeve means 26′ while a radially inner projection 50 thereof is slidably inserted in the longitudinal groove of the inner sleeve elements 43′. Each of the grindstones 32 is of the identical center of curvature to thereby form a circular shape, upon being assembled, with the same center as the sleeve means 26′ and with the diameter substantially equal to that of the piston ring 13.

Figure 7:
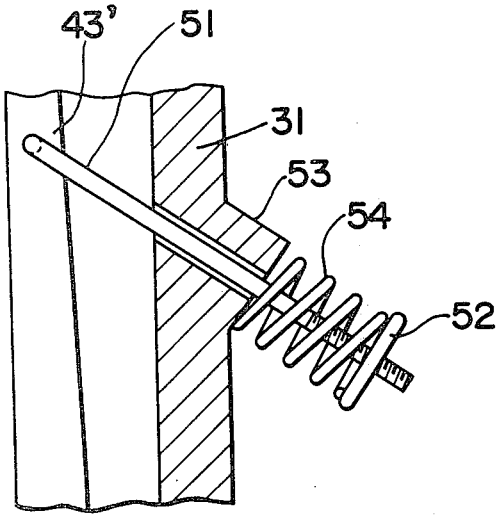
FIG. 7 is an enlarged section of a portion of FIG. 3.

In order to locate the grindstones 32 each lower or bottom end of which is put on the base 36 as well as the inner sleeve elements 43′, there are provided a plurality of rods 51 passing between the neighboring legs 48 of the adjuster 44, one end of each rod 51 being connected to the corresponding inner sleeve elements 43′ while the other end thereof being extended outward of the outer sleeve 31. Specifically in FIG. 7, the other end of each rod 51 is screw-threaded to mesh with a screw-disc 52. Between the screw-disc 52 and a shoulder 53 of the outer sleeve 31 is interposed a helical spring 54 to normally urge the rod 51 to be withdrawn off the outer sleeve 31, i.e, to enlarge the diameter of the circle constituted by the grindstones 32. The one of the rod 51 is bent at a right angle for insertion into the inner sleeve element 43′. It is to be noted that each inner sleeve element 43′ is held preferably by two rods 51, i.e; at the upper and lower portions thereof.

The guide sleeve 33 has its inner wall 55 inclined upward to facilitate insertion of the piston ring 13. The diameter of the wall 55 is substantially equal to the nominal dimension of the piston ring 13 which is, after grind-finishing, placed in a piston ring receiving shaft 56 located below the grinding sleeve means 26.

In operation, the piston ring 13 to be finished is held between the plate elements 16, 17 due to actuation of the cylinder 20 and the plunger 21 and then transferred to the upper portion of the guide sleeve 33 by the sliding movement of the plate 14 due to actuation of the fluid motor 13. The fluid motor 24 is thereafter activated to rotationally move the depressing member 25 downward with the result that the piston ring 13 is forced into frictional engagement with the grindstones 32 to be finished thereby. When the depressing member 25 is moved down to its maximum extent, the piston ring 13 has been ground and is released from the grinding sleeve means 26′ to be received in the shaft 56.

The grinding finish of a lot of piston rings 13 causes the grindstones 32 to be worn down to thereby enlarge the internal diameter thereof and make uniform tolerances of the piston rings 13 impossible. Therefore, it is necessary to adjust the internal diameter of the grindstones 32 so as to obviate the defects of enlarging the external diameter of the piston ring 13 beyond a permissible value.

In the event that the grindstones 32 are worn off, the handle 42 is manipulated to rotate the rotational member 40 thereby moving the adjuster 44 down. It is to be understood that the rotational member 40 cannot be vertically moved while the adjuster 44 is not rotated and that the rod 51 is interposed between two neighboring legs 48 without affecting the vertical movement of the legs 48 of the adjuster 44. The downward movement of the adjuster 44 will move the sleeve element 43′ or grindstones 32 in the radially inward direction against the exerting force of the springs 54 due to the opposed tapers of the inner sleeve elements 43′ and the adjuster 44, thereby compensating for the enlarged diameter of the grindstone 32. The exerting force of each helical spring 54 may be adjusted by rotation of the screw-disc 52. The base 36 limits the downward movement of the grindstones or laps 32.

After moving the grindstones 32 on the sleeve elements 43' in the radially inward direction, the guide sleeve 33 is moved up and the grinding sleeve means 26' is transferred to the dressing station due to actuation of the fluid motor 34. The motor 28 is then driven to rotationally move the diamond dresser 30 downward in unison with the spindle 29 thereby finishing the grindstones 32 to a predetermined diameter. The grinding sleeve means 26' is then moved back to its original position by means of the fluid motor 34 to resume the finishing operation of the outer surface of the piston rings 13. It is preferable that the lateral edges of the grindstones 32 be located as close to each other as possible while allowing adequate therebetween.

Figure 8:
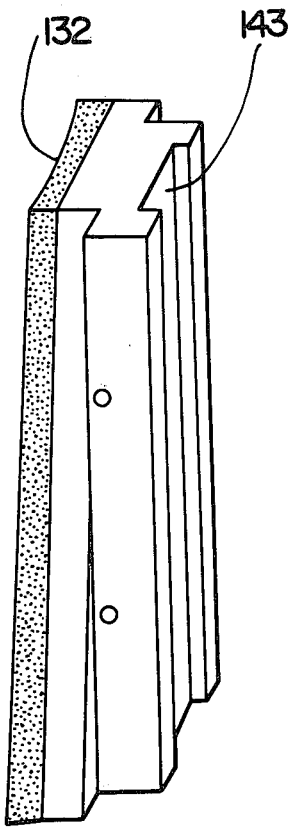
FIG. 8 is a perspective view of a modification of the sleeve element of FIG. 5.

FIG. 8 shows a modification of the inner sleeve element and the grindstones in which the axis of a grindstone 132 is inclined in the circumferential direction with respect to the axis of an inner sleeve element 143. As a consequence, the contact line between grindstones 132 is circumferentially inclined to effectively finish the outer surface of the piston rings 13.

It is to be noted that the piston rings 13 may be finished by application of a coolant containing abrasive grain materials such as synthetic diamonds by means of the sleeve means according to the present invention. In this case, a plurality of the sleeve elements are provided with lapping materials in place of the grindstones.

The foregoing detailed descriptions and illustrations of alternative embodiments of this invention have been given for clearness of understanding only and no unnecessary limitations should be construed therefrom, as other modifications will be obvious to those skilled in the art of an apparatus for grinding or lapping finish of an outer surface of piston rings.

We claim:

1. Apparatus for finish grinding of piston rings comprising:

a stationary body having a center hole, pinion means rotatably carried on the body at a position radially outward from the center hole, a scroll mounted on the body in engagement with the pinion means and having a spiral groove on the outer surface thereof, carriers having rack means for engagement with the spiral groove, guide means for sliding the carriers radially inwardly or outwardly when the scroll is rotated by the pinion means, and T-shaped inner sleeve elements comprising grindstone or lapping means secured on the inner surface thereof and comprising radially outward extending arms on the outer surface thereof, said outward extending arms being secured to said carriers and said sleeve elements being positioned within said center hole and forming a circle of selected diameter, whereby said diameter may be altered by actuation of said pinion means, said sleeve elements and grindstone or lapping means secured thereon being of sufficient length to obtain a minimum stroke of the piston ring to be finished, said length being greater than the width of said sleeve elements and grindstones or lapping means, each said grindstone or lapping means having a longitudinal axis extending along the length thereof, said longitudinal axes being inclined in a circumferential direction with respect to said center hole of said body.

* * * * *